US011178963B2

(12) United States Patent
Jeon

(10) Patent No.: US 11,178,963 B2
(45) Date of Patent: Nov. 23, 2021

(54) BOOK HOLDER CAPABLE OF HOLDING BOOKS HAVING VARIOUS THICKNESSES

(71) Applicant: Young-Chan Jeon, Suwon-si (KR)

(72) Inventor: Young-Chan Jeon, Suwon-si (KR)

( * ) Notice: Subject to any disclaimer, the term of this patent is extended or adjusted under 35 U.S.C. 154(b) by 77 days.

(21) Appl. No.: 16/635,330

(22) PCT Filed: Jul. 18, 2018

(86) PCT No.: PCT/KR2018/008096

§ 371 (c)(1),
(2) Date: Jan. 30, 2020

(87) PCT Pub. No.: WO2019/035568

PCT Pub. Date: Feb. 21, 2019

(65) Prior Publication Data

US 2020/0281351 A1 Sep. 10, 2020

(30) Foreign Application Priority Data

Aug. 14, 2017 (KR) ..... 10-2017-0102817
Sep. 14, 2017 (KR) ..... 10-2017-0117530
Mar. 13, 2018 (KR) ..... 10-2018-0029267

(51) Int. Cl.
*A47B 23/04* (2006.01)
*B42D 17/00* (2006.01)
*B42D 9/00* (2006.01)

(52) U.S. Cl.
CPC ..... *A47B 23/043* (2013.01); *B42D 17/00* (2013.01); *A47B 2220/0016* (2013.01); *A47B 2220/0069* (2013.01); *B42D 9/00* (2013.01)

(58) Field of Classification Search
CPC ..... A47B 23/043; A47B 23/042; A47B 2220/0016; A47B 2220/0069; B42D 17/00; B42D 9/00
See application file for complete search history.

(56) References Cited

U.S. PATENT DOCUMENTS 1,601,463 A * 9/1926 Vinson ..... A47B 23/043 248/451
1,728,431 A * 9/1929 Mevi ..... A47B 23/044 281/33
4,739,960 A * 4/1988 Adler ..... A47B 23/043 24/511

(Continued)

FOREIGN PATENT DOCUMENTS

JP 2011-30965 A 2/2011
JP 2012-210373 A 11/2012

(Continued)

OTHER PUBLICATIONS

Japanese Office Action dated Feb. 24, 2021 in counterpart Japanese Patent Application No. 2020-527716 (5 pages in English and 3 pages in Japanese).

(Continued)

*Primary Examiner* — Anita M King
(74) *Attorney, Agent, or Firm* — NSIP Law

(57) ABSTRACT

The present invention relates to a book holder capable of holding books having various thicknesses and, specifically, to a book holder capable of holding a thick book open, as is, without folding the pages thereof.

10 Claims, 14 Drawing Sheets

(56) References Cited

U.S. PATENT DOCUMENTS

| | | | | | |
|---|---|---|---|---|---|
| 5,154,391 | A * | 10/1992 | Hegarty | B41J 29/15 | 248/205.2 |
| 5,433,415 | A * | 7/1995 | Samson | A47B 23/043 | 248/448 |
| 5,720,465 | A | 2/1998 | Peltzer et al. | | |
| 5,797,578 | A * | 8/1998 | Graffeo | A47B 23/043 | 248/453 |
| 9,150,044 | B2 * | 10/2015 | Pencak | B42D 17/005 | |
| 2008/0149801 | A1 * | 6/2008 | Wood | A47B 23/043 | 248/450 |
| 2008/0230672 | A1 * | 9/2008 | Pachowski | A47B 23/044 | 248/453 |
| 2011/0073740 | A1 | 3/2011 | Leduc | | |

FOREIGN PATENT DOCUMENTS

| | | | |
|---|---|---|---|
| KR | 10-1231239 | B1 | 2/2013 |
| KR | 20-0473482 | Y1 | 7/2014 |
| KR | 20-0474671 | Y1 | 10/2014 |

OTHER PUBLICATIONS

International Search Report dated Sep. 18, 2018 in counterpart International Patent Application No. PCT/KR2018/008096 (2 pages in English and 2 pages in Korean).

* cited by examiner

【FIG. 1】
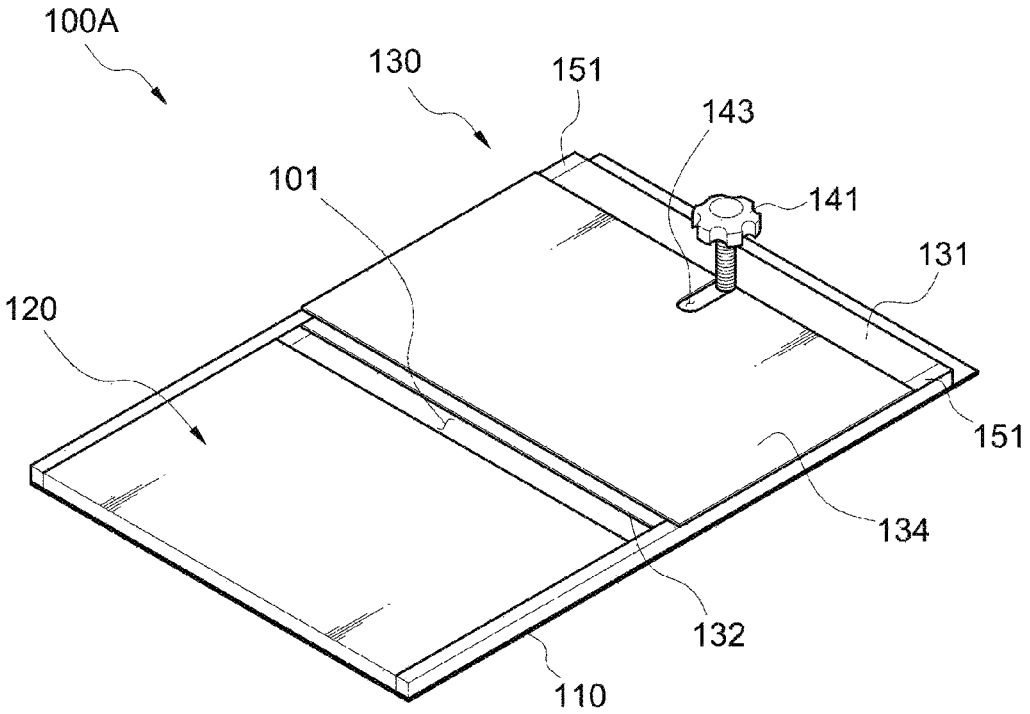

【FIG. 2】
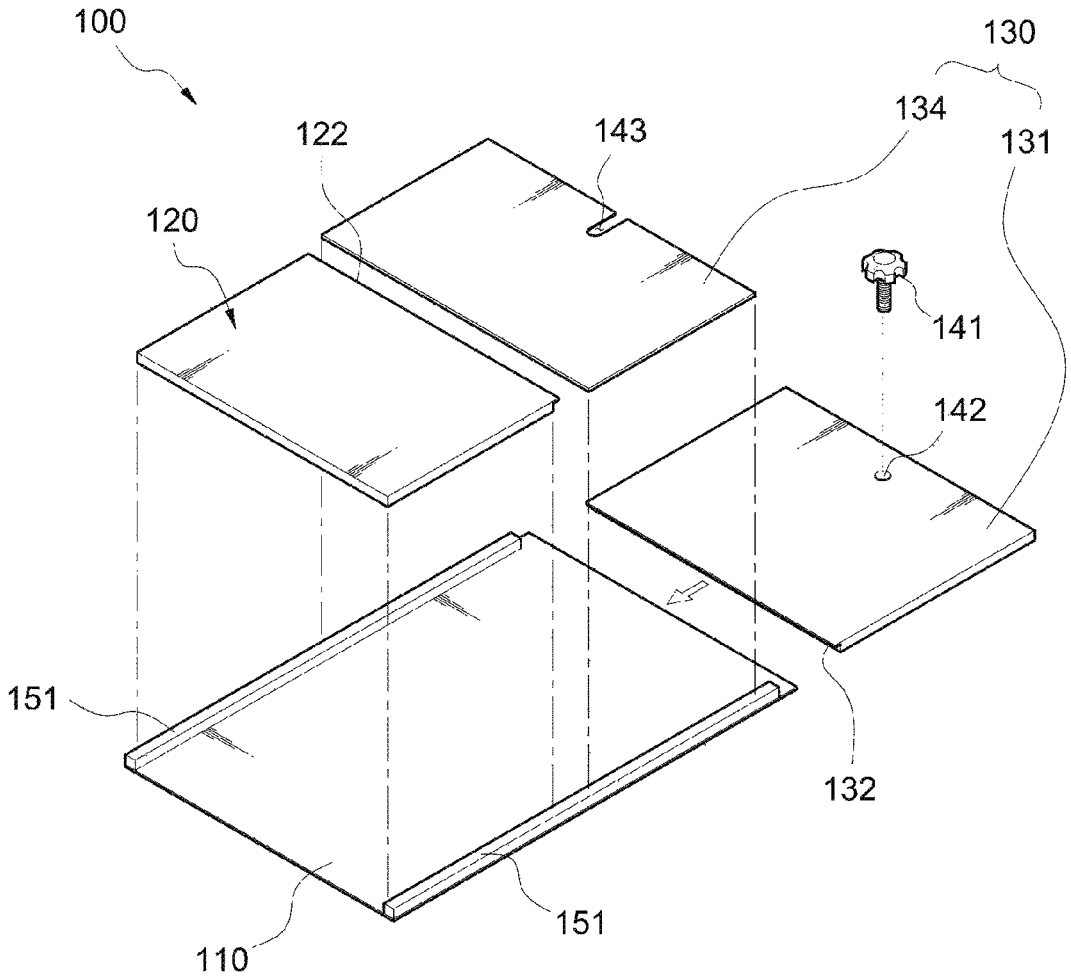

【FIG. 3】
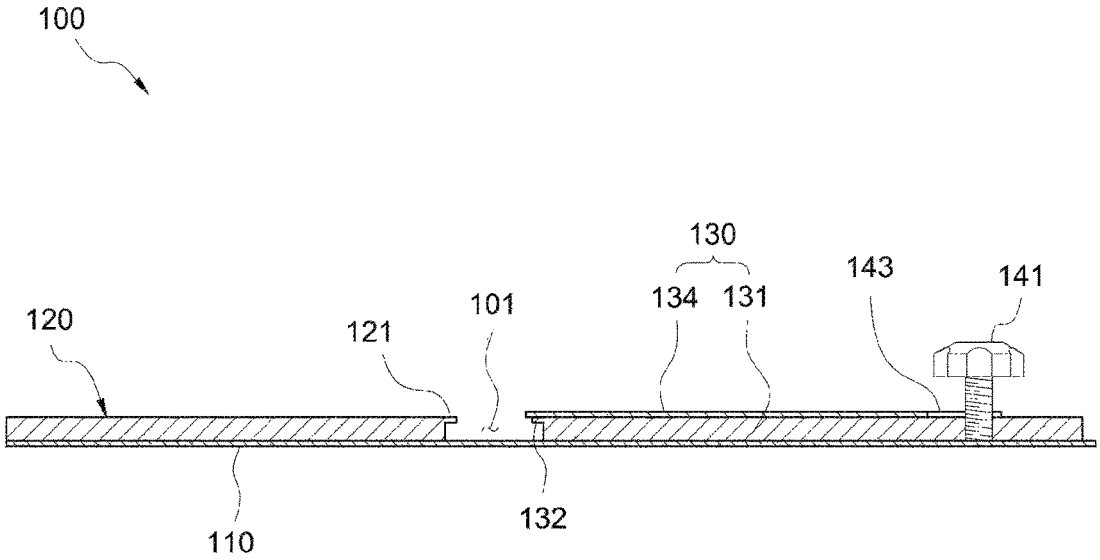
【FIG. 4】
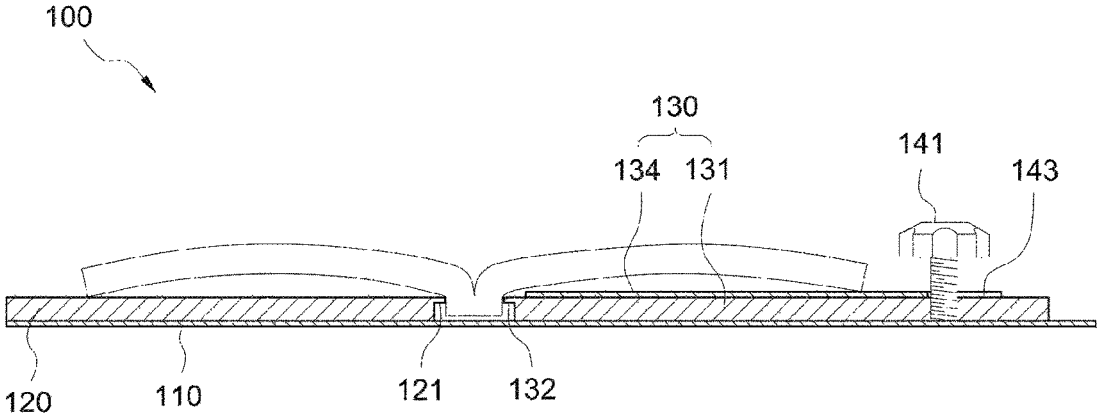

【FIG. 5】
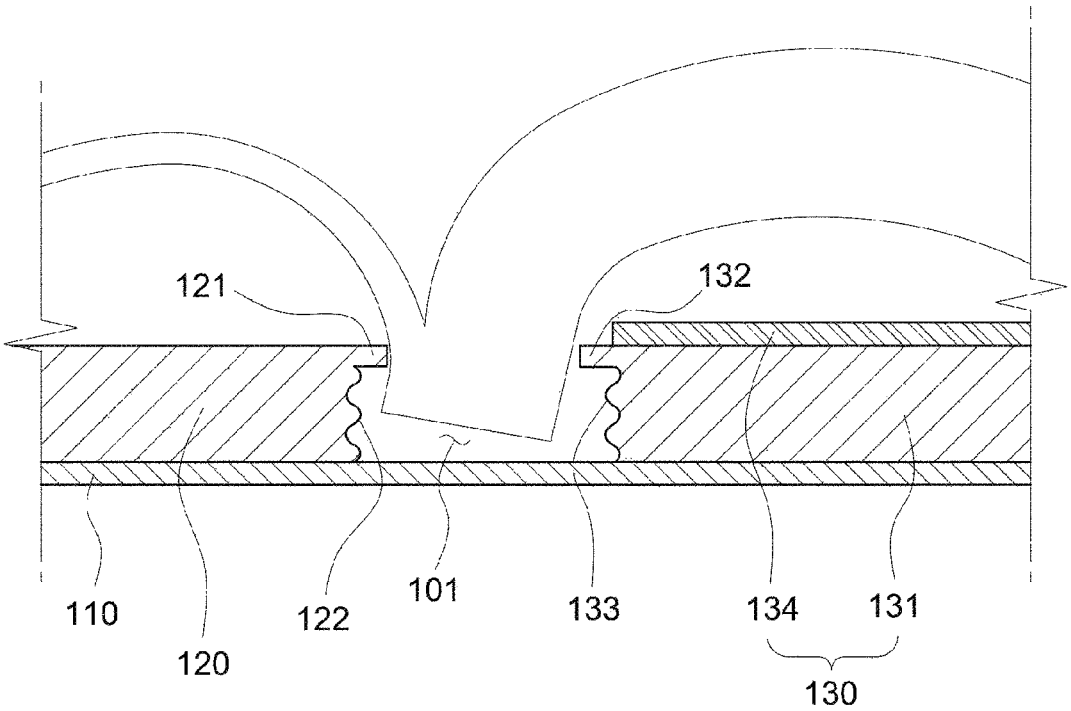
【FIG. 6】
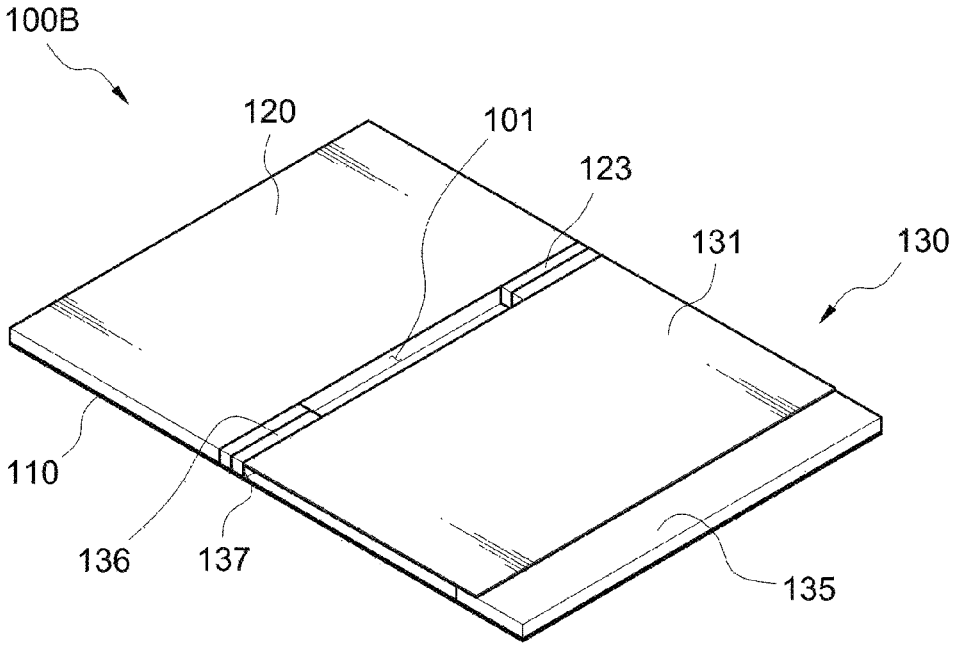

【FIG. 7】
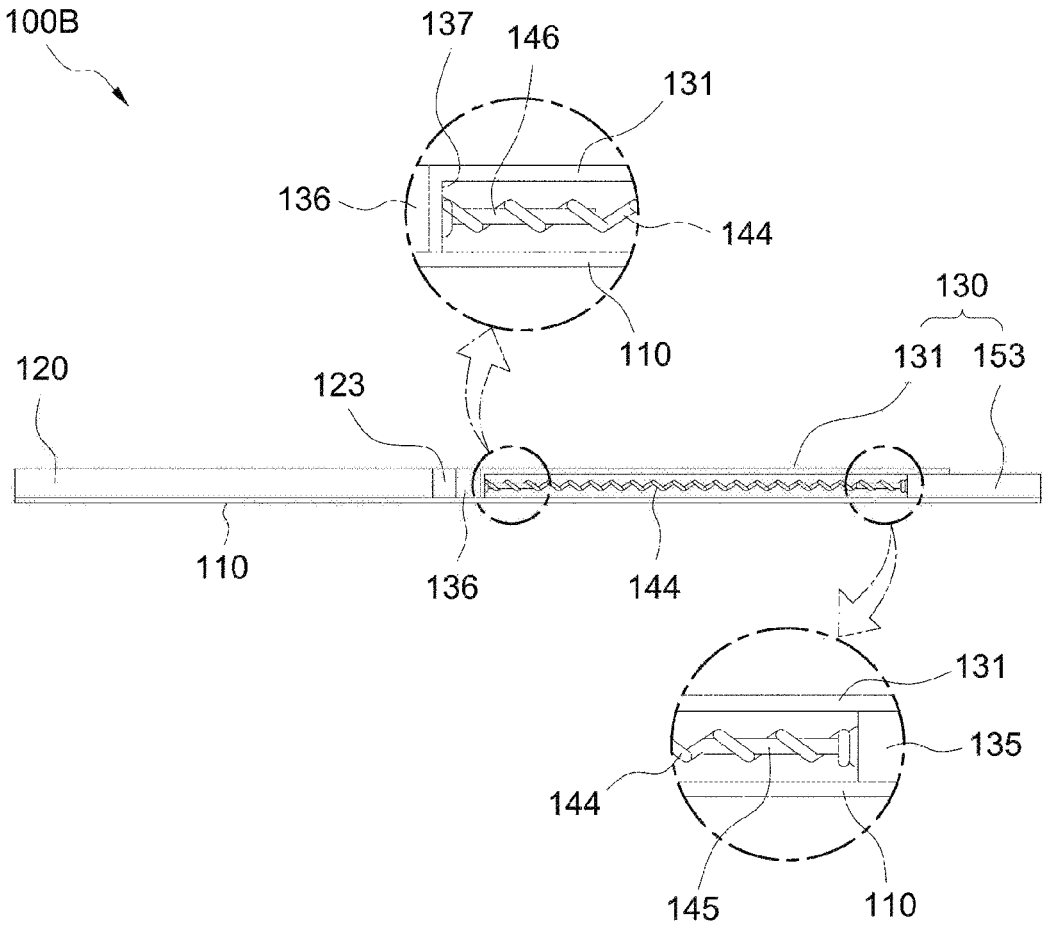

【FIG. 8】
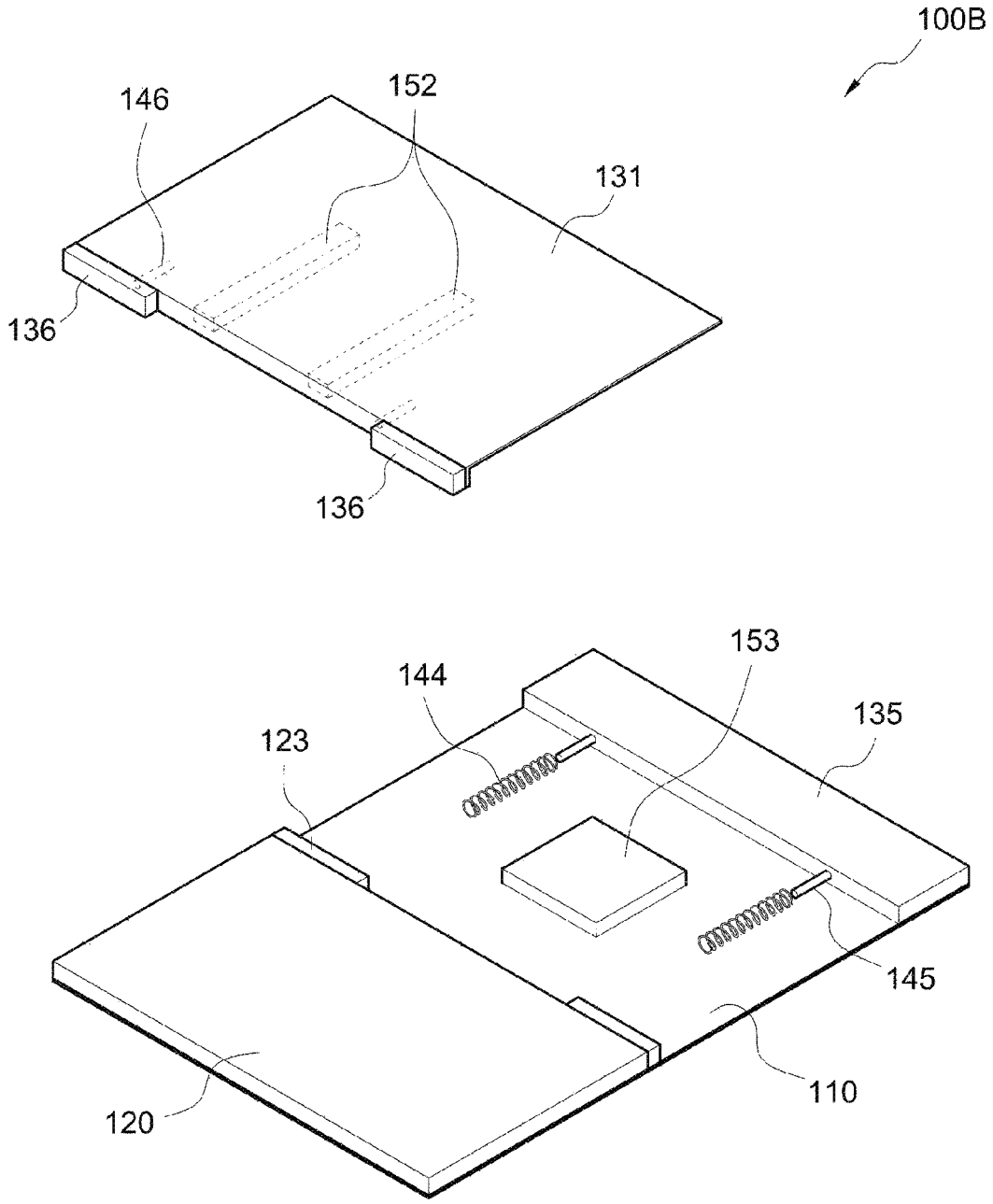

【FIG. 9】
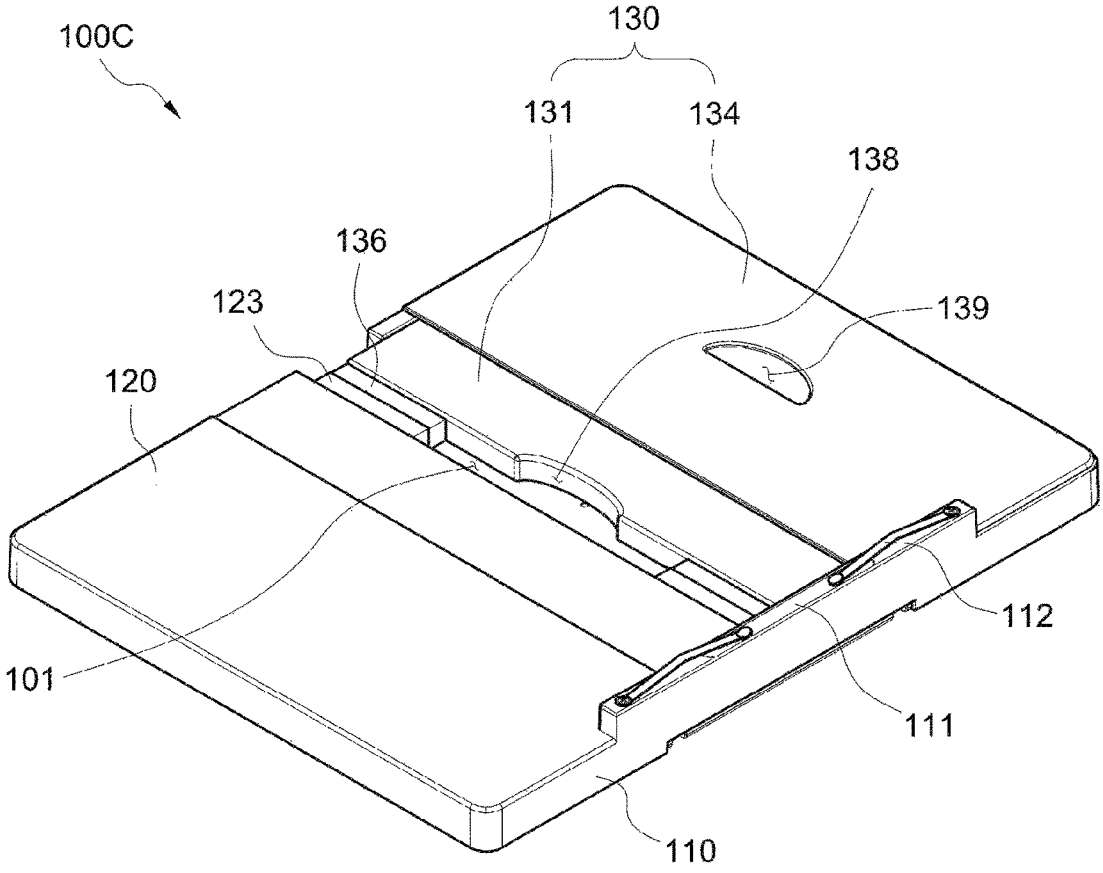

【FIG. 10】
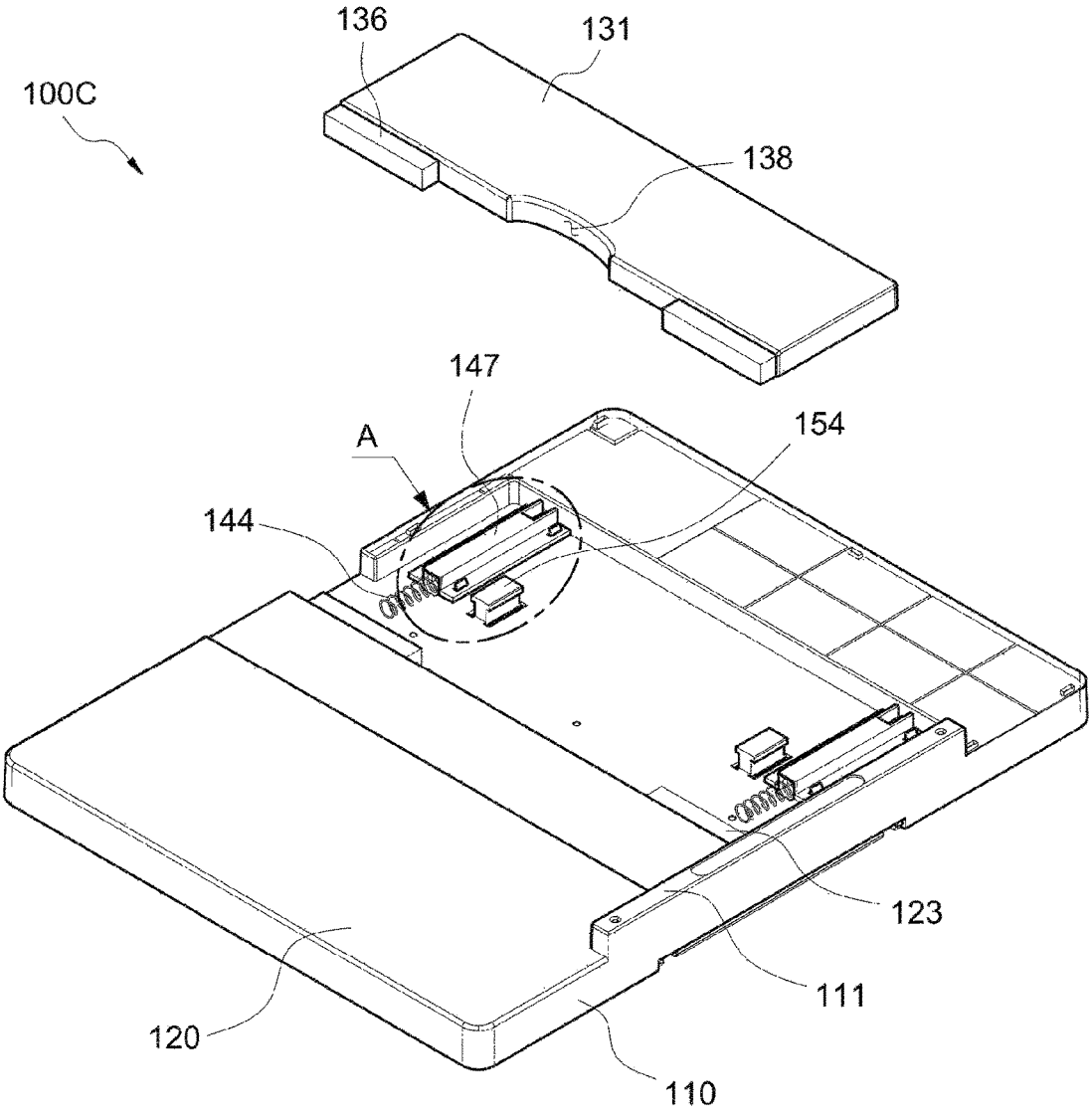

【FIG. 11】
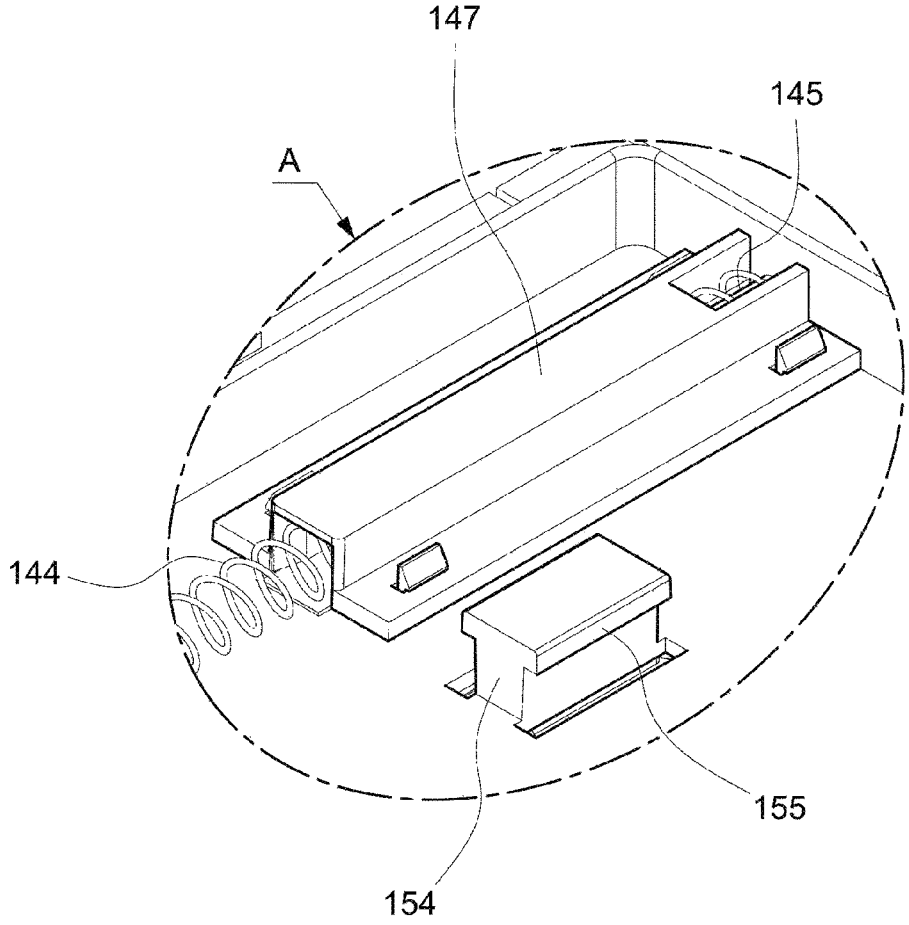

【FIG. 12】
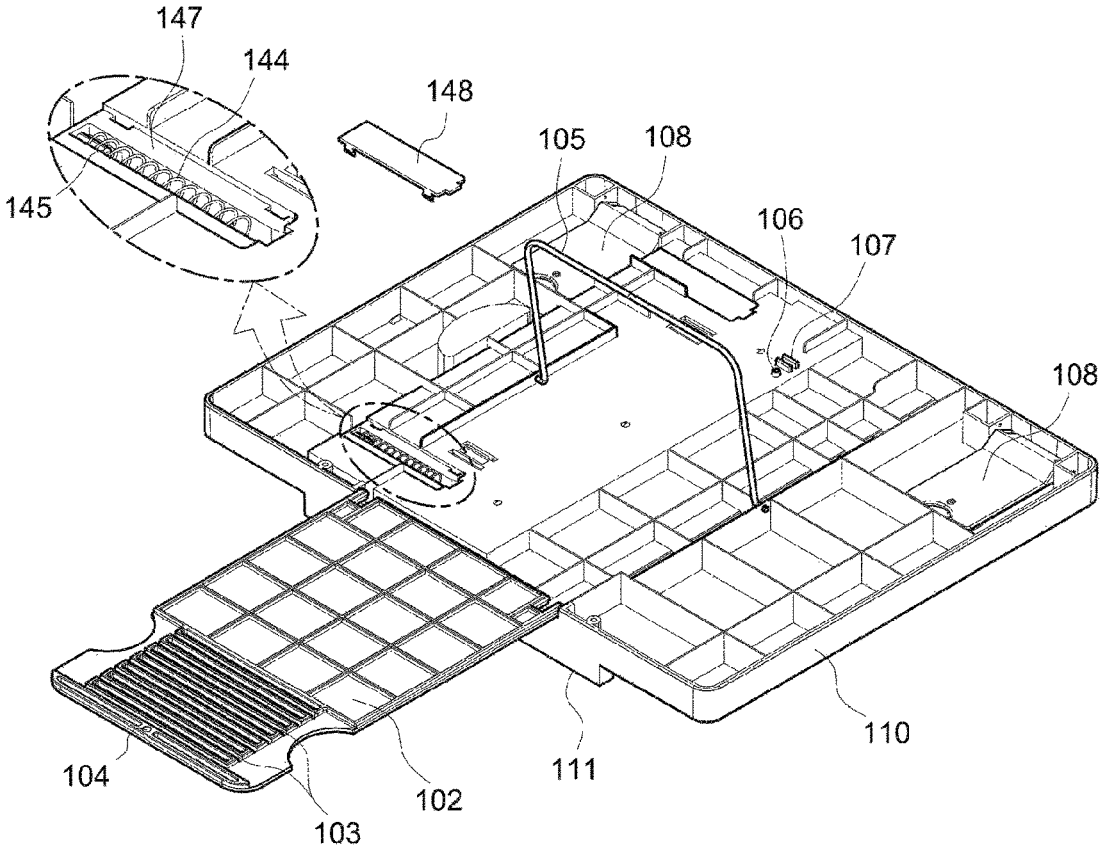

【FIG. 13】
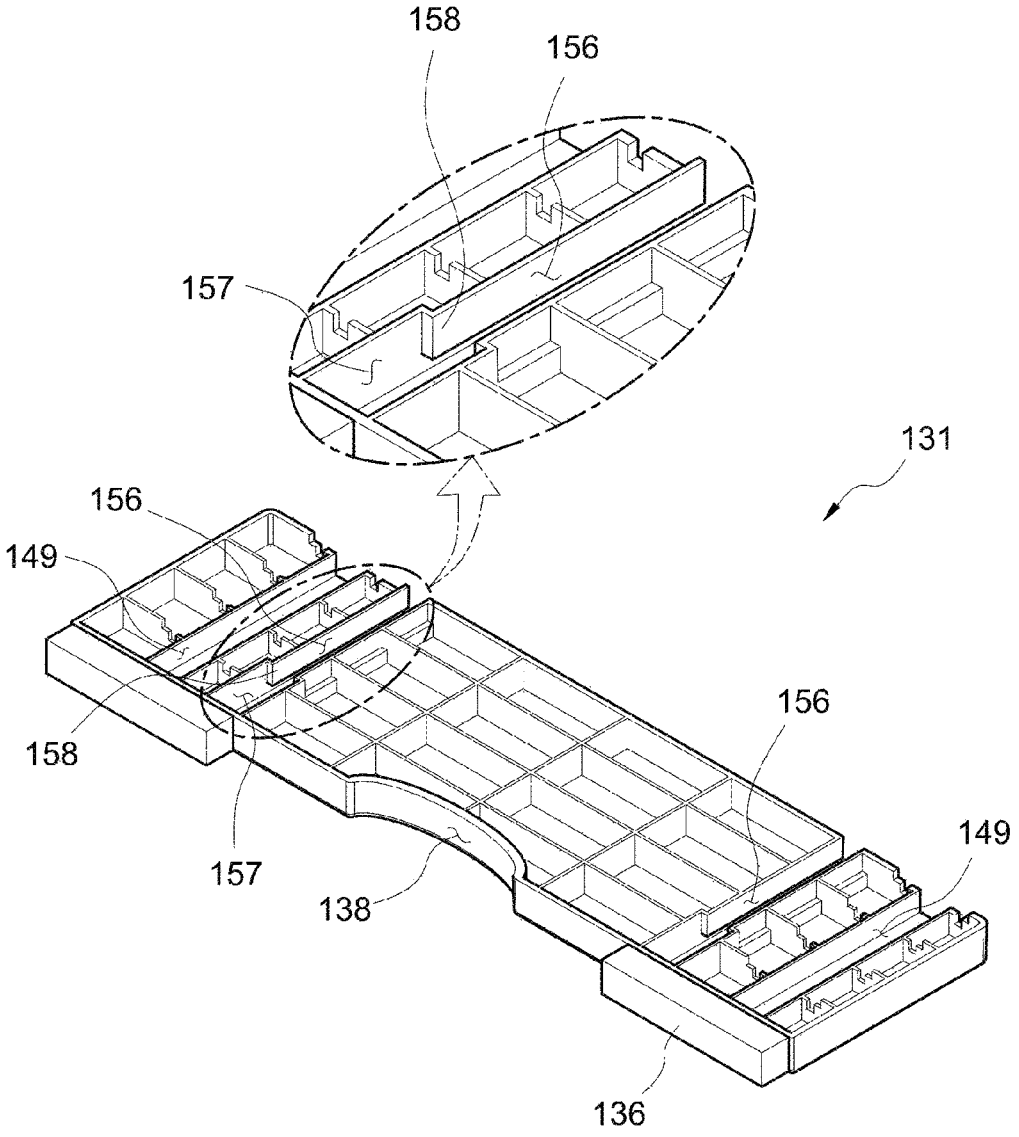

【FIG. 14】
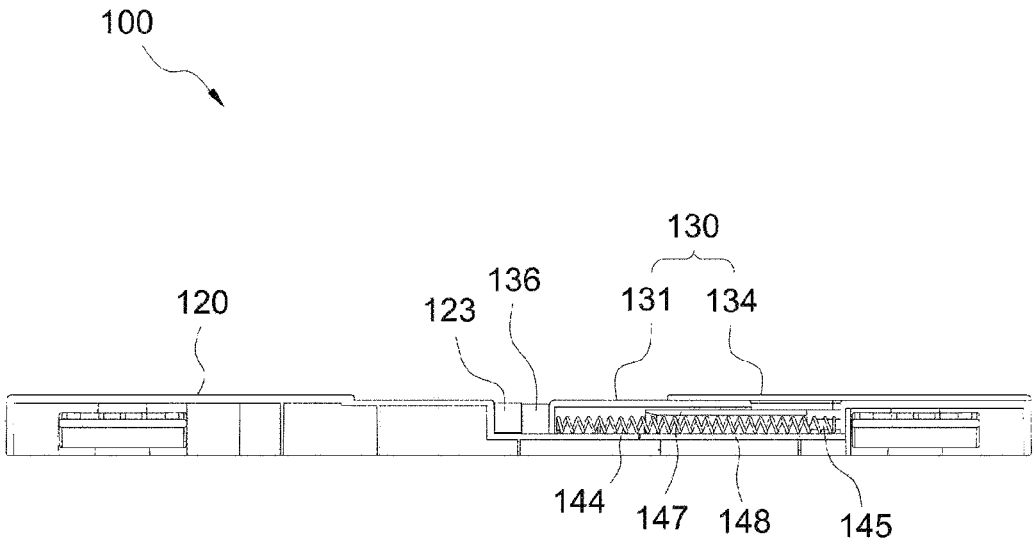
【FIG. 15】
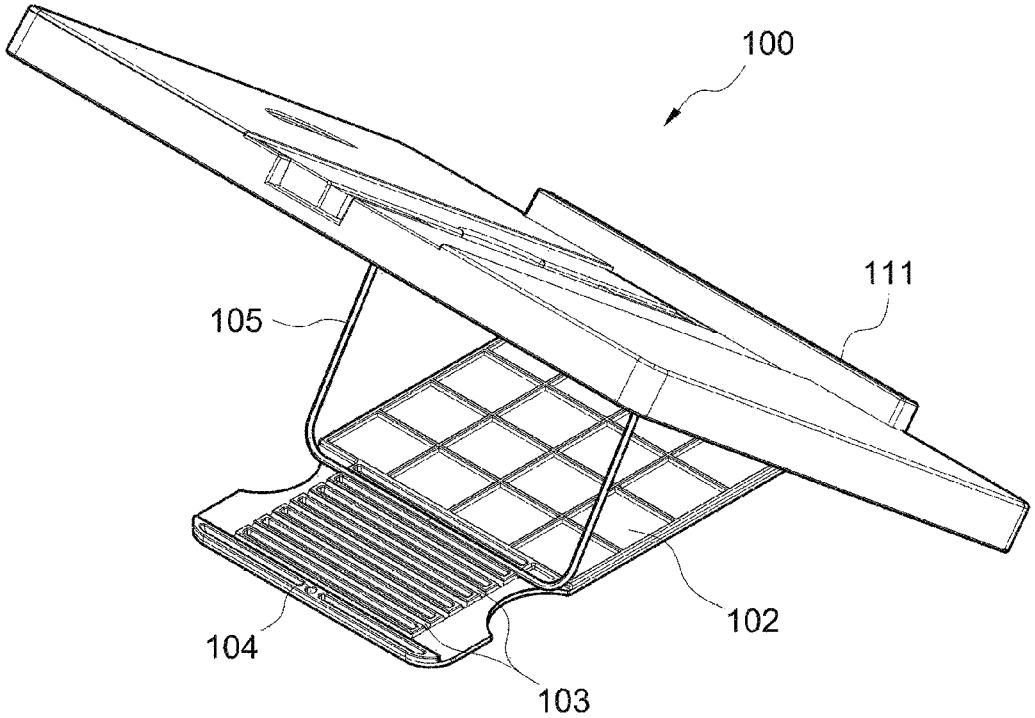

【FIG. 16】
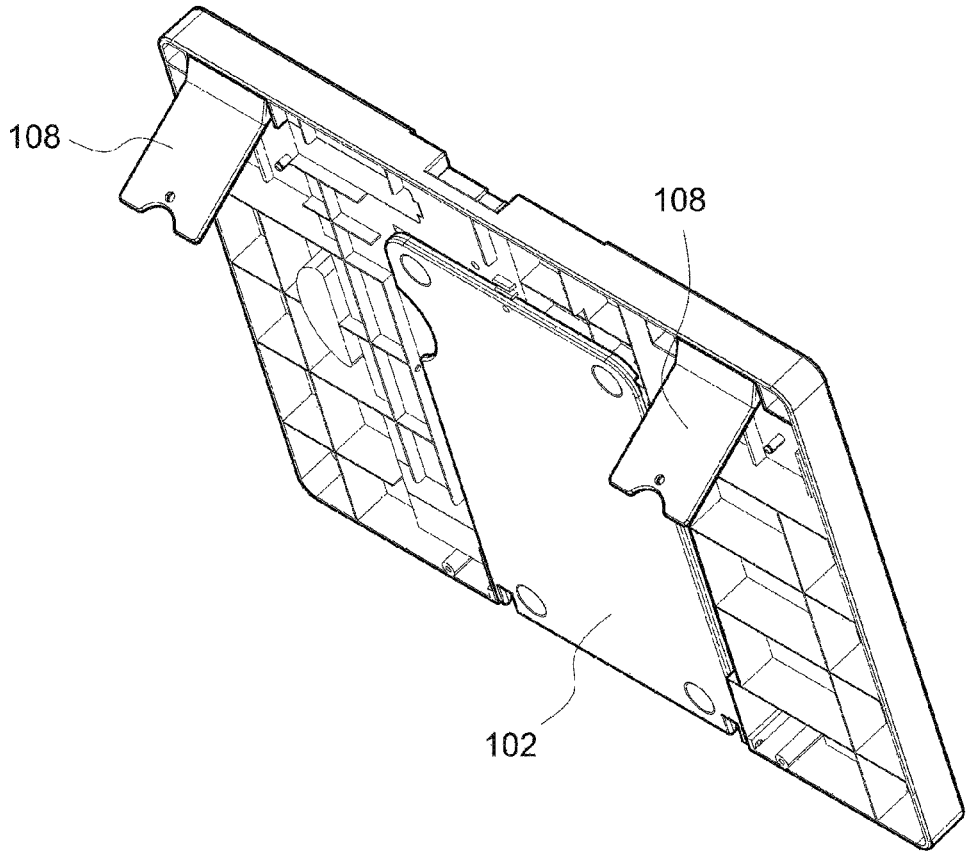

【FIG. 17】
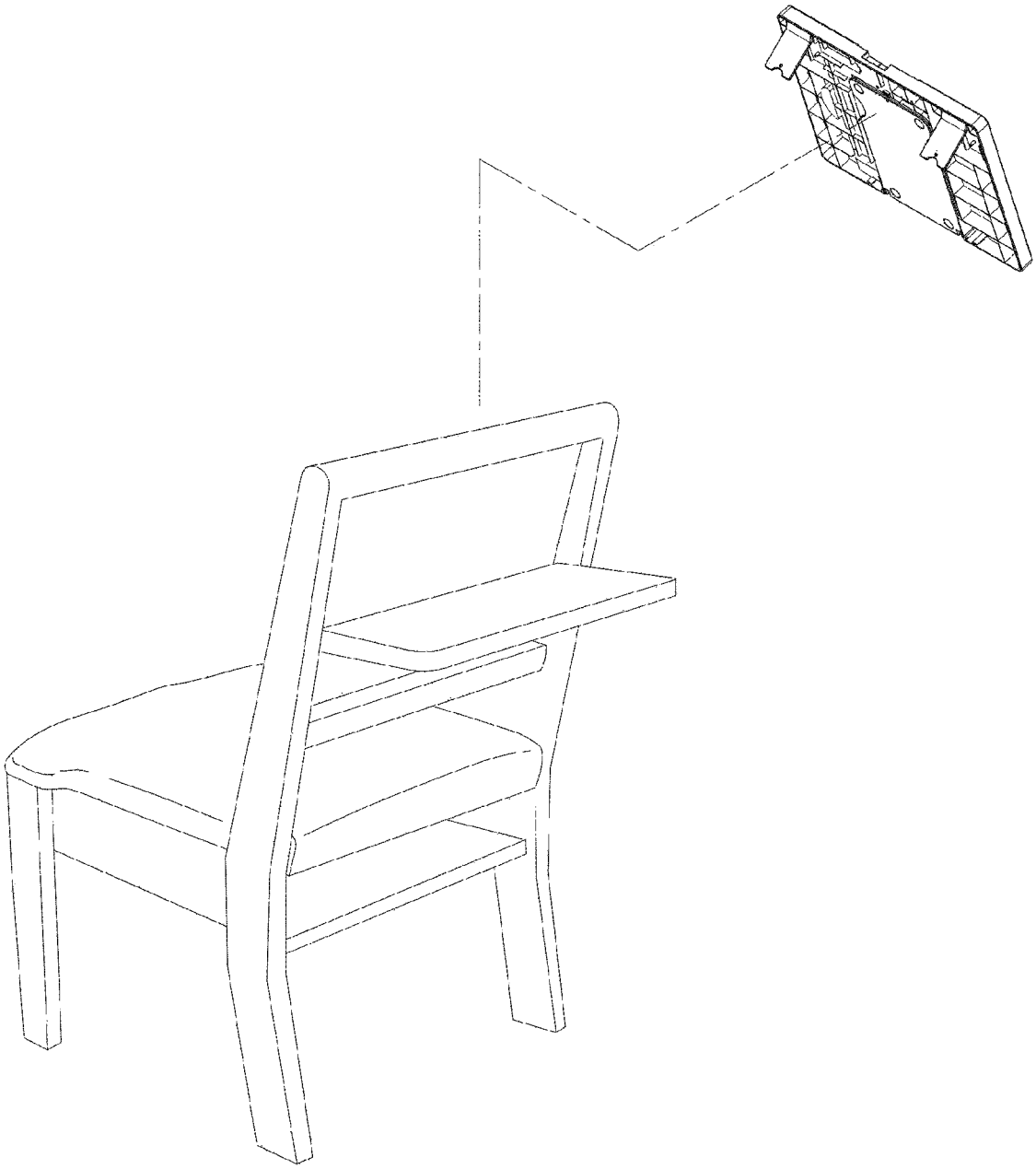

BOOK HOLDER CAPABLE OF HOLDING BOOKS HAVING VARIOUS THICKNESSES

CROSS REFERENCE TO RELATED APPLICATIONS

This application is a U.S. National Stage Application of International Application No. PCT/KR2018/008096, filed on Jul. 18, 2018, which claims the benefit under 35 USC 119(a) and 365(b) of Korean Patent Application No. 10-2017-0102817, filed on Aug. 14, 2017, Korean Patent Application No. 10-2017-0117530, filed on Sep. 14, 2017 and Korean Patent Application No. 10-2018-0029267, filed on Mar. 13, 2018 in the Korean Intellectual Property Office, the entire disclosure of which is incorporated herein by reference for all purposes.

BACKGROUND

Field

The present disclosure relates to a book holder capable of holding books having various thicknesses and, more particularly, to a book holder capable of holding an open thick book as it is without folding pages thereof.

Description of Related Art

In general, a book holder is a tool for holding a book or sheet music unfolded at an angle or position that is easy for a user to read.

A conventional book holder can stably hold an open thin book as it is without open pages turned over. However, when a thick book is open, the spine of the book does not lay flat on the book holder, thus folding the open book again.

In order to solve this problem, the conventional book holder has a pair of tongs (clips or pressing members) for pressing and fixing an open book on both sides of the book. However, these tongs cannot effectively press both sides of a thick book, thus not stably holding the book, and has inconvenience of requiring a user to release the tongs, turn over a page, and press and fix the book again with the tongs whenever needing to flip through the book.

SUMMARY

An aspect of the present disclosure is to provide a book holder capable of holding not only a thin book but also a thick book with pages open as it is without folding the book.

In view of the foregoing aspect, a book holder capable of holding books having various thicknesses according to the present disclosure includes: a base 110 formed in a plate shape; a first body 120 formed on one side of the base 110; a moving presser 131 to slide from another side of the base 110 to the first body 120 and to variably form an insertion groove 101, into which a book spine is inserted, by being spaced apart at a certain distance from the first body 120; and a fixing member to fix the moving presser 131 to be in close contact with a lateral side of the book spine.

The book holder may further include a guide member to guide the moving presser 131 to slide.

Stoppers 121 and 132 are preferably formed to protrude lateralward respectively on an end portion of the first body 120 and an end portion of the moving presser 131 which are in contact with the book spine inserted into the insertion groove 101.

Protrusions 122 and 133 are preferably formed to be spaced apart at a certain distance in a vertical direction respectively at an end portion of the first body 120 and an end portion of the moving presser 131 in contact with the book spine inserted into the insertion groove 101.

Pressing members 123 and 136 molded with a non-slip material are fastened respectively to an end portion of the first body 120 and an end portion of the moving presser 131 in contact with the book spine inserted into the insertion groove 101.

The book holder may further include a cover 134 to cover the moving presser 131.

A first holding groove 138 may be formed in a groove shape in the moving presser 131 and a second holding groove 139 may be formed in a groove shape in the cover 134 so that the moving presser 131 is spread by inserting a user's fingers into the first holding groove 138 and the second holding groove 139.

The fixing member has one side supported by the base 110 or a structure fastened to the base 110 and another side including a spring 144 to elastically support the moving presser 131 so that the moving presser 131 is elastically pressed due to elasticity of the spring 144.

The guide member includes a guide protrusion 154 protruding upwards on the base 110 and a protrusion guide groove 156 in a long hole shape formed on a lower surface of the moving presser 131 so that the guide protrusion 154 is inserted into the protrusion guide groove 156 to slide along the protrusion guide groove 156.

A wing 155 protrudes on one side or both sides of an upper surface of the guide protrusion 154 and a stopper 158 protrudes on the protrusion guide groove 156 so that the wing 155 is inserted between the stopper 158 and the base 110 to slide when the guide protrusion 154 is inserted into the protrusion guide groove 156.

A hinge 108 is fastened to a rear side of the book holder to spread at an angle less than 90°.

According to the present disclosure configured as above, an insertion groove in a groove shape to accommodate the spine of a book is formed on the surface of a book holder to fix even a thick book with a page open as it is without being folded, thus facilitating reading.

Further, the width of an insertion groove of a book holder may be changed depending on the thickness of a book placed on the book holder, thus holding books having various thicknesses.

BRIEF DESCRIPTION OF THE DRAWINGS

FIG. 1 is a perspective view illustrating a book holder according to an embodiment of the present disclosure;

FIG. 2 is an exploded perspective view illustrating the book holder according to the embodiment of the present disclosure;

FIG. 3 is a cross-sectional view illustrating the book holder according to the embodiment of the present disclosure;

FIG. 4 is a cross-sectional view illustrating a state in which the book holder is used according to the embodiment of the present disclosure;

FIG. 5 is an enlarged cross-sectional view illustrating an insertion groove of the book holder according to the embodiment of the present disclosure;

FIG. 6 is a perspective view illustrating a book holder according to another embodiment of the present disclosure;

FIG. 7 is a cross-sectional view illustrating the book holder according to the other embodiment of the present disclosure;

FIG. 8 is an exploded perspective view illustrating the book holder according to the other embodiment of the present disclosure;

FIG. 9 is a perspective view illustrating a book holder according to still another embodiment of the present disclosure;

FIG. 10 is an exploded perspective view illustrating the book holder according to the still other embodiment of the present disclosure;

FIG. 11 is an enlarged view illustrating part A of FIG. 10;

FIG. 12 is a perspective view illustrating the rear side of the book holder where a book holder support and a fixing stand of the book holder are unfolded according to the still other embodiment of the present disclosure;

FIG. 13 is a perspective view illustrating the rear side of a moving presser of the book holder according to the still other embodiment of the present disclosure;

FIG. 14 is a cross-sectional view illustrating the book holder according to the still other embodiment of the present disclosure;

FIG. 15 is a perspective view illustrating a state in which the book holder is slantly installed with the book holder support of the book holder unfolded according to the still other embodiment of the present disclosure;

FIG. 16 is a perspective view illustrating a state in which a hinge of the book holder is unfolded according to the still other embodiment of the present disclosure; and FIG. 17 illustrates a state in which the hinge of the book holder is used according to the still other embodiment of the present disclosure.

DETAILED DESCRIPTION

Description of Reference Numerals

100: book holder 101: insertion groove
102: book holder support 103: fixing groove
104: protrusion groove 105: fixing stand
106: fixing protrusion 107: fixing groove
108: hinge 110: base
111: prop 112: page pressing member
120: first body 121: stopper
122: protrusion 123: pressing member
130: second body 131: moving presser
132: stopper 133: protrusion
134: cover 135: support
136: pressing member 137: pressing side
138: first holding groove 139: second holding groove
141: fastening bolt 142: hole
143: guide hole 144: spring
145: fixing protrusion 146: fixing protrusion
147: spring housing 148: cover
149: spring groove 151: guide
152: guide bar 153: guide protrusion
154: guide protrusion 155: wing
156: protrusion guide groove 157: insertion hole
158: stopper Hereinafter, the present disclosure will be described in detail with reference to exemplary embodiments and the accompanying drawings, wherein like reference numerals refer to like elements.

It should be understood that when an element is referred to as "including" another element in a detailed description or claims of the present disclosure, unless specified otherwise stated, the element is not limited to including only the other element but is construed as further including other elements.

Book holders to be illustrated according to one embodiment, another embodiment, and still another embodiment include a base 110, a first body 120 to come in contact with one side of the spine of a book to fix the spine, a second body 130 to compress another side of the spine of the book to fix the spine, a guide member to guide the second body 130 to slide, and a fixing member to fix the second body 130.

As illustrated in FIG. 1 and FIG. 2, a book holder 100A according to one embodiment of the present disclosure includes a base 110 in a flat plate shape and guides 151 in a bar shape which are fastened to upper and lower edges of an upper surface of the base 110 and protrude upwards.

A first body 120 in a plate shape is formed on one side of the upper surface of the base 110, and a second body 130 in a plate shape is formed to be spaced apart by a certain distance from the first body 120 on another side of an upper surface of the base 110.

The second body 130 includes a moving presser 131 which slides on the upper surface of the base 110 and a cover 134 which covers the upper portion of the moving pressing unit 131.

The moving presser 131 is configured to be guided by the guides 151 to slide between the guides 151 in a direction to the first body 120, and the cover 134 is disposed on the moving presser 131 and is fastened to the guides 151.

An insertion groove 101 into which the spine of a book is inserted and fixed is formed in a gap between the first body 120 and the second body 130 as illustrated in FIG. 3.

A hole 142 in an opening shape is formed in the moving presser 131, a fastening bolt 141 is screwed into the hole, and a guide hole 143 in a long hole shape is formed in one side of the cover 134 so that the fastening bolt 141 moves along the guide hole 143 and is not disrupted by the slide of the moving presser 131 when the moving presser 131 slides.

A process of placing a book on the book holder 100A configured as above according to the present disclosure will be described.

First, as illustrated in FIG. 3, the moving presser 131 of the second body 130 is slid in the opposite direction of the first body 120 so that the spine of a book may be completely inserted into the insertion groove 101.

As illustrated in FIG. 4, the spine of the book is inserted into the insertion groove 101, the moving presser 131 is slid in the direction of the first main body 120 such that one side of the spine of the book is in contact with the first body 120 and the moving presser 131 is positioned to be in close contact with another side of the spine of the book, and the moving presser 131 is fixed so as not to move by rotatively locking the fastening bolt 141.

When the first body 120 and the moving presser 131 of the book holder 100A are in close contact with the opposite sides of the spine of the book, the book is fixed with an open page unfolded without being folded again even though the book is thick.

Here, as illustrated in FIG. 5, it is preferable to form protrusions 122 protruding in a plurality of steps at an end portion of the first body 120 in contact with the spine of the book and to form a stopper 121 protruding outwards above the protrusions 122.

Similarly, it is preferable to form protrusions 133 protruding in a plurality of steps at an end portion of the moving presser 131 in contact with the spine of the book and to form a stopper 132 protruding outwards above the protrusions 133.

By forming the protrusions 122 and 133 in the plurality of steps and the stoppers 121 and 132 at the end portion of the first body 120 and the end portion of the moving pressure unit 131, it is possible to securely fix an unfolded thick book to the book holder.

Referring to FIG. 5, when a first part or a last part of a thick book is unfolded with the spine of the thick book inserted into the insertion groove 101 of the book holder 100A, the spine of the book is rotated to one side due to an imbalance in weight. As a result, the moving presser 131 may be pushed by rotatory force, so that the spine of the book may be displaced from the insertion groove 101 and the book may be folded accordingly.

When the stoppers 121 and 132 protruding outwards are formed at the end portion of the first body 120 and the end portion of the moving pressure unit 131 as in FIG. 5, if the spine of a book is rotated due to an imbalance in weight, the spine of the book is rotated in a space under the stoppers 121 and 132 to absorb a displacement, thereby preventing the moving presser 131 from being pushed and thus preventing the spine of the book from being displaced from the insertion groove 101.

Further, when the spine of the book is rotated, an edge of the spine of the book is stopped by the protrusions 122 of the first body 120 or the protrusions 133 of the moving presser 131 to prevent the spine of the book from being further rotated, thus securing fixing the spine of the book so as not to be displaced from the insertion groove 101.

In the foregoing embodiment of the present disclosure, the fastening bolt 141 is used as a fixing member for fixing the moving presser 131 in close contact with the spine of a book. In another embodiment of the present disclosure, a spring is used as a fixing member for fixing the moving presser 131 in close contact with the spine of a book.

In another embodiment of the present disclosure, as illustrated in FIG. 6 to FIG. 8, a first body 120 is formed on one side of a base 110, and a second body 130 including a support 135 and a moving presser 131 is formed on another side of the base 110.

The first body 120 may be molded separately from the base 110 and may be fastened to the base 110, or may be integrally molded with the base 110.

The first body 120 and the second body 130 are spaced apart at a certain distance so that an insertion groove 101 is formed. A pressing member 123 is fastened to an end portion of the first body 120 in contact with the spine of a book, and a pressing member 136 is also fastened to an end portion of the second body 130 in contact with the spine of the book.

The pressing member 123 is in close contact with both sides of the spine of a book to securely fix the spine of the book and may be molded with various materials which is electrically transformable to press both sides of the spine of a book and has a non-slip function, such as synthetic resin, rubber, and sponge.

With the first body 120 fixed to the base 110, the moving presser 131 of the second body 130 is slid in a direction to the first body 120 to adjust the width of the insertion groove 101, thereby allowing books having various thicknesses to be inserted and fixed into the insertion groove 101.

In the other embodiment of the present disclosure, as illustrated in FIG. 8, a guide member for guiding the moving presser 131 to slide in the direction of the first body 120 has a pair of guide bars 152 formed to be spaced apart at a certain distance on a lower surface of the moving presser 131, and a guide protrusion to be inserted between the guide bars 152 is formed to protrude upwards on an upper surface of the base 110 where the moving presser 131 is disposed.

The width of the guide protrusion 153 is the same as or slightly smaller than the distance between the guide bars 152.

Therefore, the guide protrusion 153 of the base 110 is inserted between the guide bars 152 formed on the lower surface of the moving presser 131, thus guiding the moving presser 131 to slide only in the direction of the first body 120.

A fixing member is included to fix the moving presser 131 in close contact with the spine of a book inserted into the insertion groove 101. In the other embodiment of the present disclosure, a spring 144 is used as a fixing member.

As illustrated in FIG. 7 and FIG. 8, the support 135 protrudes upwards on one side of the base 110, and the spring 144 is inserted between the support 135 and the moving presser 131, and thus the spring 144 is supported by the support 135 and the moving presser 131 elastically comes in close contact with the spine of a book to be fixed.

The support 135 may be separately molded to be fastened to the base 110, or may be integrally molded with the bottom 110.

Here, as illustrated in FIG. 8, it is preferable to fix the spring 144 so as not to move by forming a fixing protrusion 145 to fix the spring 144 on the support 135 and forming a fixing protrusion 146 on the moving presser 131.

The spring 144 may be a compression spring or a tension spring.

A process of placing a book on the book holder 100B configured as above according to the other embodiment of the present disclosure will be described.

First, the moving presser 131 of the book holder 100B in a state illustrated in FIG. 6 is slid in the opposite direction of the first body 120, thereby opening the insertion groove 101 so that the spine of a book may be inserted thereinto.

As illustrated in FIG. 6, the pressing members 136 are formed at the end portion of the first body 120 and an end portion of the moving presser 131, respectively, thus forming a space for a user's hand. The user puts a hand in this space to move the moving presser 131.

When the spine of a book is inserted into the open insertion groove 101 and then the moving presser 131 is released, the moving presser 131 is slid in a direction to the spine of the book due to the elasticity of the spring 144 installed under the moving presser 131. When the moving presser 131 comes in close contact with the spine of the book, the moving presser 131 presses the spine of the book due to the elasticity of the spring, thereby securely fixing the book to the book holder 100B.

In an alternative embodiment of the present disclosure, the book holder 100B may be configured without the elastic pressing members being fastened to the end portion of the first body 120 and the end portion of the moving presser 131.

Here, as in the book holder 100A according to the embodiment of the present disclosure, protrusions protruding in a plurality of steps may be formed at an end portion of the first body 120 in contact with the spine of a book, and a stopper protruding outwards may be formed above the protrusions. Likewise, protrusions protruding in a plurality of steps may be formed at an end portion of the moving presser 131 in contact with the spine of the book, and a stopper protruding outwards may be formed above the protrusions.

FIG. 9 is a perspective view illustrating a book holder 100C according to still another embodiment of the present disclosure.

As illustrated in FIG. 9, the book holder 100C according to the embodiment of the present disclosure includes: a first body 120 integrally formed with a base 110 on one side of the base 110; and a second body 130 formed on another side of the base 110 and including a moving presser 131 covered by a cover 134, wherein the moving presser 131 of the second body 130 is configured to slide in a direction to the first body 120.

An insertion groove 101 into which the spine of a book is inserted to be fixed is formed between an end portion of the first body 120 and the moving presser 131, and elastic pressing members 123 and 136 are respectively fastened to the end portion of the first body 120 and an end portion of the moving presser 131 in order to securely press and fix the spine of a book inserted into the insertion groove 101.

A fixing member to fix the moving presser 131 in close contact with the spine of a book inserted into the insertion groove 101 is configured as follows.

FIG. 10 illustrates the moving presser 131 which is detached and from which the cover 134 of the second body 130 is removed.

As illustrated in FIG. 10, a spring housing 147 is formed on an upper surface of the base 110 where the moving presser 131 is disposed, and a spring 144 is inserted into the spring housing 147 so that one side of the spring 144 is supported by the spring housing 147 and the other side of the spring 144 is exposed in a direction to the first body 120.

Here, as illustrated in FIG. 11 and FIG. 12, it is preferable to form a fixing protrusion 145 protruding in the spring housing 147 so that the spring 144 in a coil shape inserted into the spring housing 147 is configured to be inserted and fixed into the fixing protrusion 145.

Further, as illustrated in FIG. 12, it is preferable to form a cover 148 to open and close the spring housing 147 on a lower surface of the base 110 so that the cover 148 can be opened on a lower surface of the book holder 100C to insert or replace the spring 144.

As illustrated in FIG. 13, a spring groove 149 into which the spring 144 is inserted is formed on a lower surface of the moving presser 131 so that the spring 144 is inserted into the spring groove 149 to elastically support the moving presser 131 when the moving presser 131 is disposed on the base 110.

A guide member to guide the moving presser 131 to slide in the direction to the first body 120 is configured as follows.

As illustrated in FIG. 10 and FIG. 11, a guide protrusion 154 protrudes upwards on the upper surface of the base 110 where the moving presser 131 is disposed. As illustrated in FIG. 11, the guide protrusion 154 has wings 155 protruding on both sides of an upper surface of the guide protrusion 154 in a bar shape.

As illustrated in FIG. 13, a protrusion guide groove 156 in a long hole shape into which the guide protrusion 154 is inserted is formed on the lower surface of the moving presser 131. Accordingly, when the moving presser 131 is disposed on the upper surface of the base 110, the guide protrusion 154 protruding on the upper surface of the base 110 is inserted into the protrusion guide groove 156 formed on the lower surface of the moving presser 131 so that the moving presser 131 may be guided to slide only in the direction to the first body 120.

Here, the wings 155 protruding are formed on both sides of the upper surface of the guide protrusion 154 as illustrated in FIG. 11, and a stopper 158 protruding is formed at the back of the protrusion guide groove 156, that is, in the opposite direction of the elastic pressing member 136, as illustrated in FIG. 13. Accordingly, when the guide protrusion 154 is inserted into an insertion hole 157 of the protrusion guide groove 156 and the moving presser 131 is slid, the wings 155 of the guide protrusion 154 are inserted between the stopper 158 of the projection guide groove 156 and the base 110, and the moving presser 131 does not move in an up-and-down direction but slides only in the direction of the first body 120.

A process of placing a book on the book holder 100C configured as above according to the still other embodiment of the present disclosure will be described.

In a state illustrated in FIG. 9, a user spreads the moving presser 131 to widen the insertion groove 131 so that the spine of a book to be placed can be inserted into the insertion groove 131.

Here, as illustrated in FIG. 9, it is preferable to form a first holding groove 138 in a groove shape in an end portion of the moving presser 131 and to form a second holding groove 139 in a groove shape in the cover 134 so that the user can conveniently slide the moving presser 131 even with one hand by inserting a thumb into the first holding groove 138 and inserting an index, middle, or ring finger into the second holding groove 139.

Referring to FIG. 14, since the spring 144 is supported by the spring housing 147 to elastically press the moving presser 131 to the first body 120, when the moving presser 131 is slid and spread, the spring 144 is elastically transformed.

When the spine of a book is inserted into the insertion groove 101 and the moving presser 131 is released, the moving presser 131 is slid toward the first body 120 due to the elasticity of the spring 144 to press a lateral portion of the spine of the book, thereby securely fixing the book to the insertion groove 101.

It is preferable to configure a fixing device for slantly fixing the book holder 100C in order to facilitate reading of a book placed on the book holder 100C.

As illustrated in FIG. 12, the fixing device is configured by hinging a book holder support 102 in a plate shape on the lower surface of the base 110 and by hinging a fixing stand 105 at a middle or upper portion of the base 110.

The book holder support 102 includes fixing grooves 103 which are consecutively formed at predetermined intervals and into which the fixing stand 105 is inserted. Accordingly, when the fixing stand 105 is spread and is inserted into the fixing grooves 103 of the book holder support 102, the book holder 100C is slantly fixed as illustrated in FIG. 15.

Referring to FIG. 12, it is preferable to form a fixing groove 107 on the lower surface of the base 110 in order to fix the fixing stand 105 as folded so that the fixing stand 105 is folded and inserted into the fixing groove 107 in order to fix the fixing stand 105 as folded.

Further, as illustrated in FIG. 12, it is preferable to form a protrusion groove 104 at an end portion of the book holder support 102 in order to fix the book holder support 102 as folded and to form a fixing protrusion 106 on the lower surface of the base 110 so that the fixing protrusion 106 is inserted into the protrusion groove 104 when the book holder support 102 is folded to thereby fix the book holder support 102 as folded.

As illustrated in FIG. 15, it is preferable to form a prop 111 protruding in a lower portion of the book holder 100C so that a book does not slip down when the book holder 100C is slantly installed using the fixing stand 105 and the book holder support 102.

Further, in order to hang the book holder on the back of a front chair in a church to place a thick bible thereon, a hinge 108 is fastened to an upper portion of the rear side of the book holder 100C as illustrated in FIG. 16 and is spread to be hung on the back of a chair as illustrated in FIG. 17.

The hinge 108 is limited to a spreading angle less than 90°.

According to the present disclosure configured as above, an insertion groove in a groove shape to accommodate the spine of a book is formed on the surface of a book holder to fix even a thick book with a page open as it is without being folded, thus facilitating reading.

Further, the width of an insertion groove of a book holder may be changed depending on the thickness of a book placed on the book holder, thus holding books having various thicknesses.

A book holder configured as above according to the present disclosure may be used as a music stand for a music and may be configured to protrude on a desk when embedded in the desk for use.

Technical ideas of the present disclosure have been described with reference to the foregoing embodiments.

It will be apparent to those skilled in the art to which the present disclosure pertains that various changes and modifications can be made to the foregoing embodiments from details of the present disclosure.

Although not explicitly illustrated or described, it will be apparent to those skilled in the art to which the present disclosure pertains that various changes and modifications including technical ideas according to the present disclosure can be made, and these changes and modifications still fall within the scope of the present disclosure.

The foregoing embodiments described with reference to the accompanying drawings are illustrated for the purpose of describing the present disclosure and do not limit the scope of the present disclosure.

The invention claimed is:

1. A book holder capable of holding books having various thicknesses, the book holder comprising:

a base formed in a plate shape;

a first body formed on one side of the base;

a moving presser to slide from another side of the base to the first body and to variably form an insertion groove, into which a book spine is inserted, by being spaced apart at a certain distance from the first body;

a fixing member to fix the moving presser to be in close contact with a lateral side of the book spine; and a cover to cover the moving presser.

2. The book holder as claimed in claim 1, further comprising a guide member to guide the moving presser to slide toward the first body.

3. The book holder as claimed in claim 2, wherein the guide member comprises a guide protrusion protruding upwards on the base and a protrusion guide groove in a long hole shape formed on a lower surface of the moving presser so that the guide protrusion is inserted into the protrusion guide groove to slide along the protrusion guide groove.

4. The book holder as claimed in claim 3, wherein a wing protrudes on one side or both sides of an upper surface of the guide protrusion and a stopper protrudes on the protrusion guide groove so that the wing is inserted between the stopper and the base to slide when the guide protrusion is inserted into the protrusion guide groove.

5. The book holder as claimed in claim 1, wherein stoppers and are formed to protrude lateralward respectively on an end portion of the first body and an end portion of the moving presser which are in contact with the book spine inserted into the insertion groove.

6. The book holder as claimed in claim 1, wherein protrusions and are formed to be spaced apart at a certain distance in a vertical direction respectively at an end portion of the first body and an end portion of the moving presser in contact with the book spine inserted into the insertion groove.

7. The book holder as claimed in claim 1, wherein pressing members and molded with a non-slip material are fastened respectively to an end portion of the first body and an end portion of the moving presser in contact with the book spine inserted into the insertion groove.

8. The book holder as claimed in claim 1, wherein a first holding groove is formed in a groove shape in the moving presser and a second holding groove is formed in a groove shape in the cover so that the moving presser is spread by a user inserting fingers into the first holding groove and the second holding groove.

9. The book holder as claimed in claim 1, wherein the fixing member has one side supported by the base or a structure fastened to the base and another side comprising a spring to elastically support the moving presser so that the moving presser is elastically pressed due to elasticity of the spring to fix the moving presser to be in close contact with the book spine.

10. The book holder as claimed in claim 1, wherein a hinge is fastened to a rear side of the book holder to spread at an angle less than 90°.

* * * * *